US008833813B2

(12) United States Patent
Muller et al.

(10) Patent No.: US 8,833,813 B2
(45) Date of Patent: Sep. 16, 2014

(54) HANDLE DEVICE

(75) Inventors: Dirk Muller, Essen (DE); Mario Christensen, Mulheim (DE); Stefan Monig, Schwelm (DE); Christof Brauner, Essen (DE); Martin Witte, Ahaus (DE); Norbert Heller, Viersen (DE)

(73) Assignee: Huf Hulsbeck & Furst GmbH & Co. (DE)

( * ) Notice: Subject to any disclaimer, the term of this patent is extended or adjusted under 35 U.S.C. 154(b) by 102 days.

(21) Appl. No.: 13/502,656

(22) PCT Filed: Sep. 18, 2010

(86) PCT No.: PCT/DE2010/001113
§ 371 (c)(1),
(2), (4) Date: Apr. 18, 2012

(87) PCT Pub. No.: WO2011/047653
PCT Pub. Date: Apr. 28, 2011

(65) Prior Publication Data

US 2012/0205923 A1 Aug. 16, 2012

(30) Foreign Application Priority Data

Oct. 20, 2009 (DE) ..... 10 2009 045 871

(51) Int. Cl.

| | |
|---|---|
| ***E05B 3/00*** | (2006.01) |
| ***E05B 85/16*** | (2014.01) |
| *E05B 85/10* | (2014.01) |
| *E05B 77/06* | (2014.01) |

(52) U.S. Cl.
CPC ..... *E05B 85/107* (2013.01); *E05B 85/103* (2013.01); *E05B 77/06* (2013.01); *E05B 85/16* (2013.01)
USPC ..... 292/336.3

(58) Field of Classification Search
USPC ..... 292/1, 336.3, DIG. 31, DIG. 65
See application file for complete search history.

(56) References Cited

U.S. PATENT DOCUMENTS

| | | | | |
|---|---|---|---|---|
| 3,153,552 | A * | 10/1964 | Sandor | 292/336.3 |
| 5,904,385 | A * | 5/1999 | Linder | 292/336.3 |
| 6,158,788 | A | 12/2000 | Ikeda et al. | |
| 6,768,413 | B1 * | 7/2004 | Kemmann et al. | 340/5.72 |
| 7,108,301 | B2 * | 9/2006 | Louvel | 292/336.3 |
| 7,375,299 | B1 * | 5/2008 | Pudney | 200/61.62 |
| 8,146,393 | B2 * | 4/2012 | Katagiri et al. | 70/208 |
| 2007/0069531 | A1 | 3/2007 | Herbert et al. | |

FOREIGN PATENT DOCUMENTS

| | | |
|---|---|---|
| DE | 40 02 963 C1 | 7/1991 |
| DE | 100 00 540 C1 | 8/2001 |
| DE | 10309821 A1 | 9/2004 |

(Continued)

OTHER PUBLICATIONS

International Search Report under date of Apr. 7, 2011, in connection with PCT/DE2010/001113.

*Primary Examiner* — Kristina Fulton
*Assistant Examiner* — Christine M Mills
(74) *Attorney, Agent, or Firm* — Quarles & Brady LLP

(57) ABSTRACT

A handle device includes a handle part which is operatively connected to a locking device and movably mounted in relation to a door of a vehicle. The handle part at least partially extends through an opening of the door and can be displaced between a rest position and an operational position. The handle device further includes a cover arrangement fastened to the handle part with respect to an outer side of the door.

15 Claims, 9 Drawing Sheets

(56) References Cited

FOREIGN PATENT DOCUMENTS

Figure 1:
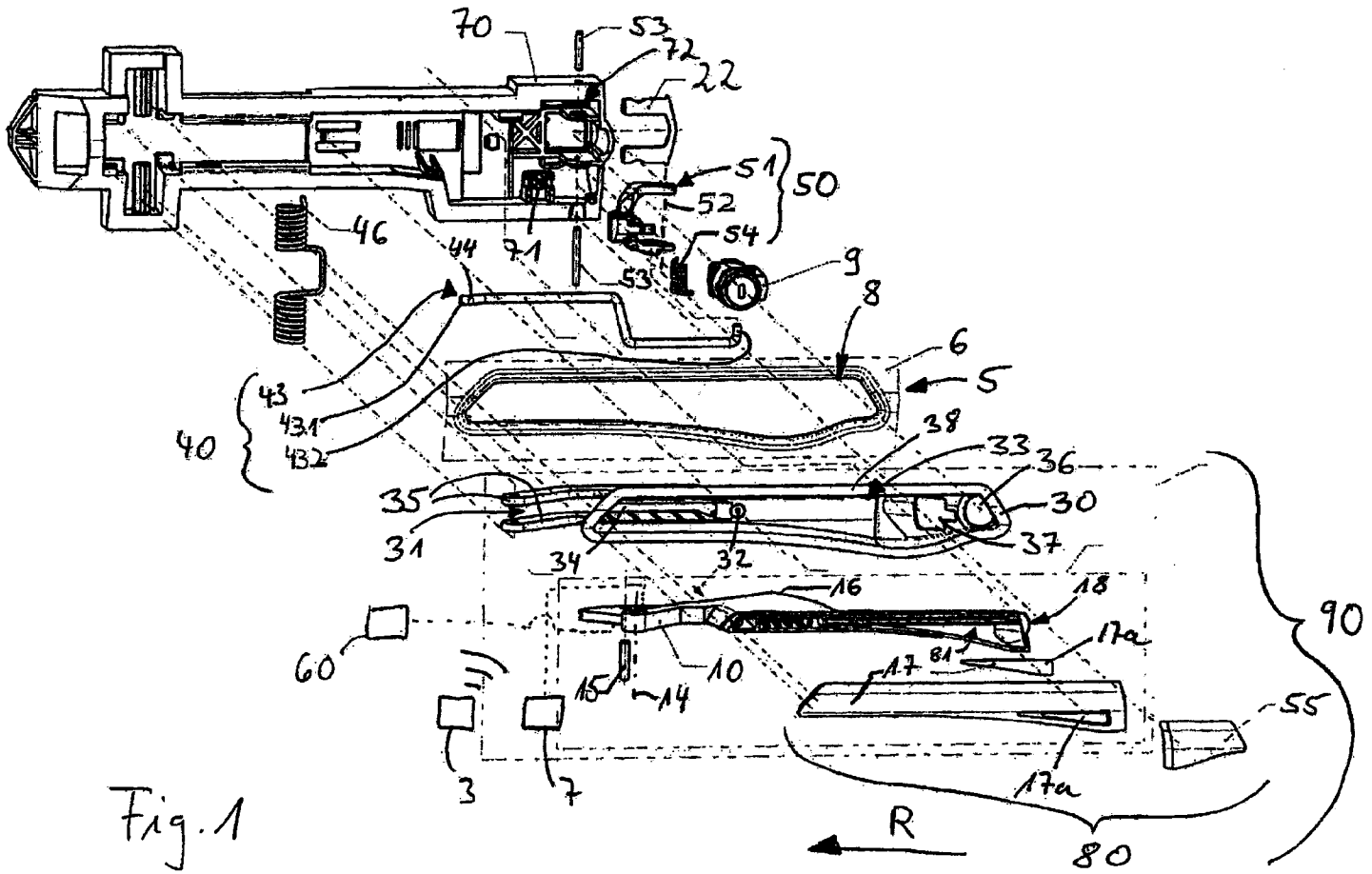

| | | | |
|---|---|---|---|
| DE | 102004036663 | A1 | 3/2006 |
| DE | 102006012063 | A1 | 9/2007 |
| DE | 10 2006 027473 | A1 | 12/2007 |
| DE | 102006055100 | A1 | 5/2008 |
| DE | 102008028391 | A1 | 12/2009 |
| EP | 0 822 306 | A2 | 2/1998 |
| EP | 1 234 934 | A2 | 8/2002 |
| EP | 1670555 | A2 | 12/2005 |
| EP | 1 985 784 | A1 | 10/2008 |
| FR | 2857684 | A1 | 1/2005 |
| GB | 1120527 | | 7/1968 |
| WO | 02/29184 | A1 | 4/2002 |
| WO | 2004/013435 | A1 | 2/2004 |

* cited by examiner

HANDLE DEVICE

CROSS-REFERENCE TO RELATED APPLICATIONS

This application claims priority to PCT International Application No. PCT/DE2010/001113 filed on Sep. 18, 2010, which claims priority to German Patent Application No. 10 2009 045 871.9 filed on Oct. 20, 2009, both of which are fully incorporated by reference herein.

The invention relates to a handle device for a locking device of a vehicle, with a handle part which is mounted movably with respect to a door of the vehicle, an overall opening which is provided within the door and through which the handle part at least partially extends and can be displaced between a rest position and an operating position.

DE 10 2004 036 663 A1 describes an outside door handle for actuating a door lock and/or door for a motor vehicle body. It has proven disadvantageous that defective enameling may occur on the handle part. Consequently, the entire handle device or the movable handle part has to be exchanged, which is associated with a considerable outlay on installation.

It is the object of the present invention to provide a handle device, wherein the abovementioned disadvantages are avoided and, in particular, when defective enameling occurs, the outlay on installation is kept as low as possible.

In order to achieve this object, a handle device with the features of claim 1 is proposed. Preferred developments are explained in the dependent claims.

For this purpose, it is provided according to the invention that a cover arrangement is provided, said cover arrangement being fastened with respect to the outer side of the door to the handle part.

The essential core of this invention is that, firstly, the cover arrangement can simply and conveniently be fastened to the handle part. In this connection, the cover arrangement can be fastened to the handle part in an interlocking and/or frictional and/or integrally bonded manner. Should errors occur in the enameling of the door or in the enameling of the handle device, the cover arrangement can easily and conveniently be detached from the handle part and, for example, replaced by a second, error-free cover arrangement.

The cover arrangement is advantageously arranged substantially flush with the outer side of the door, in particular exactly flush with the outer side of the door. The virtually flush arrangement of the cover arrangement with the outer side of the door makes it possible to greatly reduce any wind noises which occur. In addition, in the rest position of the handle part, the entire handle device is virtually recessed in the door and is therefore not visible, as a result of which, for example, soiling of the handle part can be virtually prevented. Furthermore, protruding handles from the prior art involve a risk of injury in certain boundary situations, said risk being virtually ruled out by a cover arrangement arranged flush on the outer side of the door.

A measure improving the invention can make provision for an electronic unit to be arranged on the handle part, said electronic unit in particular being part of a security system, in particular of an access and/or a driving authorization control system. The electronic unit can be arranged, for example, in a cavity of the handle part, which cavity is reliably closed and sealed by the cover arrangement. The electronic unit can likewise be insert molded and located within the handle part.

The security system can be in data communication with a mobile ID transmitter. By a conscious action of the user, in particular on the ID transmitter and/or the handle device, an identification check can be carried out between the ID transmitter and the security system. Upon a positive identification, an unlocking operation of the locking device can be carried out.

It is also possible for a handle shell to be provided, said handle shell being arranged on the overall opening and on which the handle part is movably mounted. In this case, the handle shell largely conceals the overall opening, as a result of which that region of the handle device which is located within the door and those components of the handle device which are located within the door can be protected from environmental influences. At the same time, the handle shell provides a bearing for the handle part, and, in particular, the handle shell has a bearing point at which the handle part can be pivoted about an axis between the rest position and the operating position, and vice versa.

According to the invention, provision may be made for a handle mount to be provided, said handle mount being arranged fixedly within the door and to which the handle shell is fastened. A particular advantage of this invention arises from the fact that a first installation module is formed by the handle part and the handle shell, wherein the first installation module is insertable on the overall opening of the door and is fastenable to the handle mount. In this connection, it is conceivable for the handle part and the handle mount to be standard components which can be used in different vehicle models. The overall arrangement and the handle shell including the cover arrangement can be designed individually depending on the vehicle model, thus enabling the overall costs of a handle device to be reduced.

According to the invention, the handle shell can conceal the overall opening and the handle shell can have at least a first opening for the handle part. It is conceivable for the handle shell to have a second opening for a locking cylinder.

The cover arrangement can be, for example, enameled and/or chromium-plated.

The handle shell expediently has a receptacle in which the handle part is accommodated in the rest position thereof. By contrast, in the operating position, the handle part protrudes from the receptacle.

It is likewise conceivable for an actuating unit to be provided, said actuating unit being operatively connected to the handle part in such a manner that, when the actuating unit is activated, the handle part can be displaced between the rest position and the operating position, in particular that the actuating unit has an actuating element mounted movably on the handle mount, and in particular that the actuating element is mounted pivotably on the handle mount.

In addition, provision can be made for the handle shell to have a third opening through which the actuating element at least partially protrudes.

According to the invention, it may be advantageous for the cover arrangement to have a first and a second cover, wherein the first cover is fastened to the handle part and the second cover is fastened to the actuating element, and wherein, in particular, the first cover is arranged adjacent to the second cover. The first and the second covers may be configured in form for diverse alternatives of the handle device. In addition, the first and the second cover may be matched to the handle part and/or to the handle shell with a corresponding gap size. Any electronics may be provided below the first and/or the second cover. For example, it is conceivable for an illuminating means to be provided, the electronics of which are arranged behind the cover arrangement. In addition, sensors, in particular proximity sensors and/or contact sensors, can be provided behind the cover arrangement. The abovementioned electronic components for illumination or the abovementioned sensors can be arranged on the handle part and/or on the cover arrangement itself or on the actuating element.

The cover arrangement is advantageously correspondingly matched in shape and size to the handle shell and to the receiving opening of the handle shell.

In one embodiment of the invention, the handle shell can have an elongate extent in which the handle part having a likewise elongate extent bears at least flush, wherein the actuating unit is preferably arranged adjacent to the handle part as an extension of the elongate extent of the handle part. By this means, a compact overall arrangement of the handle device can be obtained, wherein, at the same time, the outlay on installation for the fastening of the first installation module, which is composed of the handle part and the handle shell, can be reduced.

When the actuating unit is actuated, the second cover can be pivoted in the direction of the handle part, wherein the second cover preferably pivots under the handle part as soon as the handle part moves together with the first cover from the rest position in the direction of the operating position. In this connection, it is possible for the second cover to conceal the locking cylinder and, when the actuating unit is activated, for the actuating element to release the locking cylinder by means of the second cover. The second cover can therefore act as a movable protective cap for the locking cylinder. The locking cylinder can be accessible to the user via a corresponding movement of the actuating element, wherein a key can be inserted into the locking cylinder in order, in particular, to trigger locking and/or unlocking or a corresponding activation of the locking device in order to open the door lock.

A blocking unit which is arranged on the handle mount and is intended for preventing an unintentional opening of the door as a consequence of the effect of accelerations acting on the handle part is advantageously provided. The blocking unit here constitutes a crash interlock in the event of any accelerations acting on the handle part, which accelerations may arise, for example, in the event of a side impact. Furthermore, the blocking unit acts as a drive which can be connected both to the actuating unit and to the handle part. Via a corresponding activation of the actuating unit, the blocking unit is correspondingly activated and can be displaced between a locking position and a release position, wherein, at the same time, the blocking unit can move the handle part from the rest position into the operating position. An unintentional opening of the door is prevented in the locking position. In the release position of the blocking unit, the user can actuate the handle part, and in particular can initiate opening of the vehicle door by pulling on the handle part.

Furthermore, the handle part can have a collar region onto which the first cover is placed, wherein, in particular, the collar region has latching elements which interact with counter-latching elements of the first cover. By this means, a releasable connection can be obtained between the first cover and the handle part. It is also conceivable for the second cover to have at least one latching element which interacts with a counter-latching element of the actuating element, in particular the second cover has a guide running on the inside with respect to the actuating element, as a removal aid. In this case too, a releasable fastening can be obtained between the second cover and the actuating element, thus affording advantages during installation and/or removal.

Figure 2:
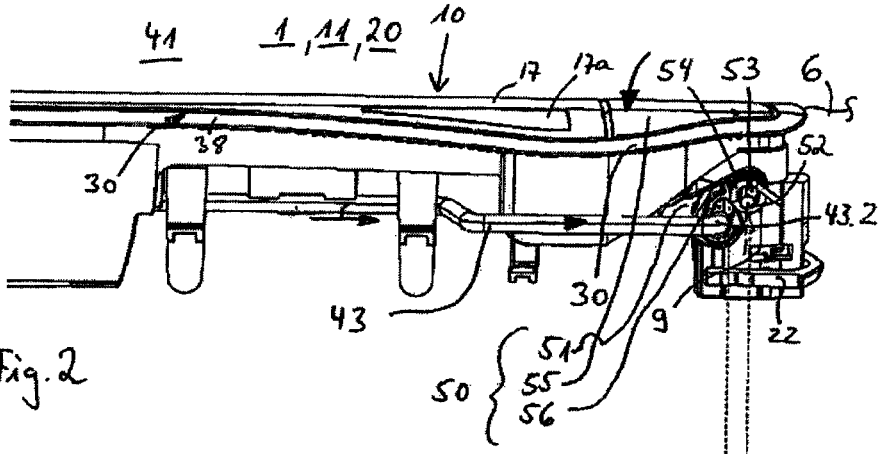
Figure 3:
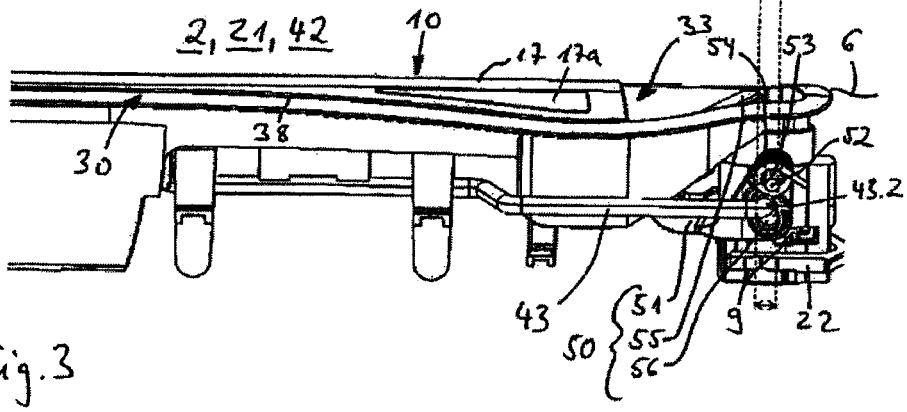
Figure 4:
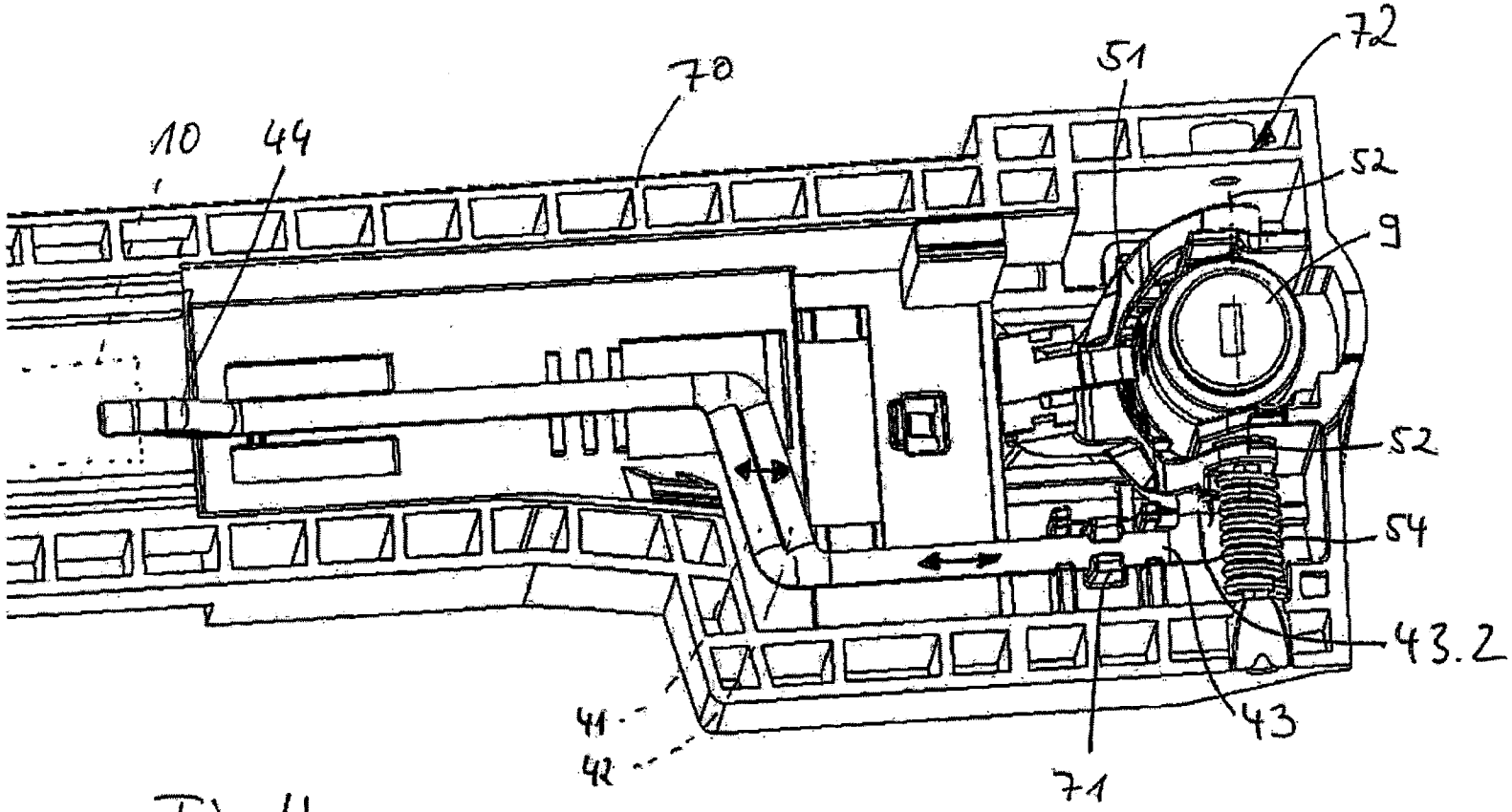
Figure 5:
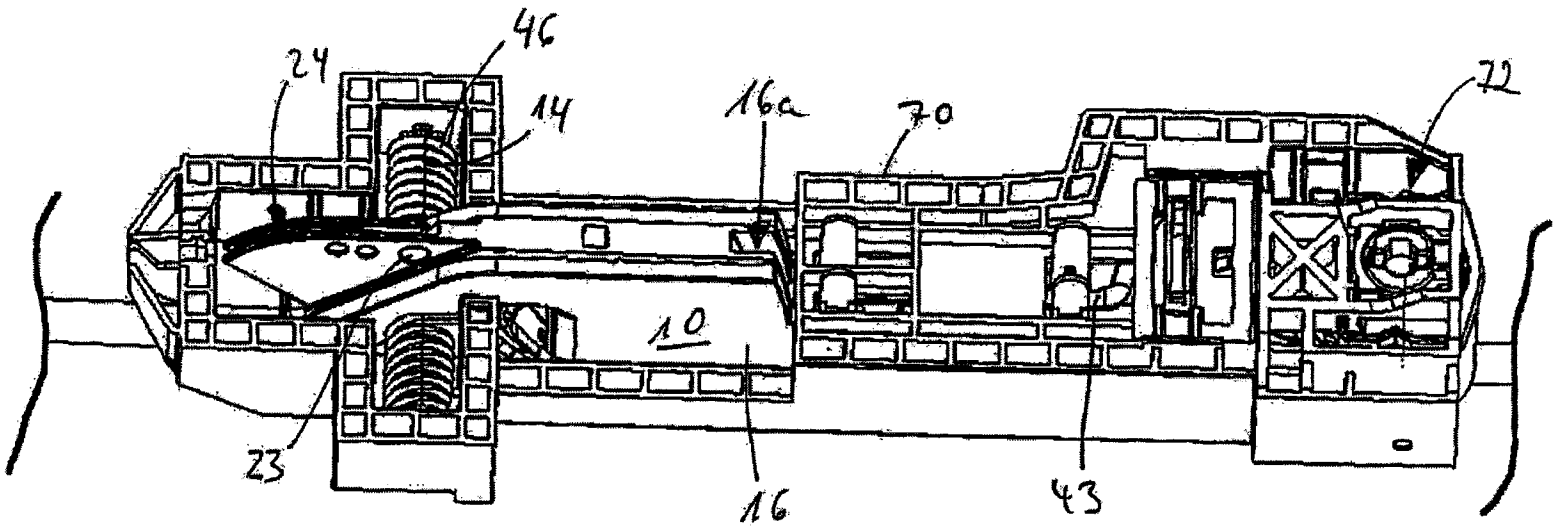
Figure 6B:
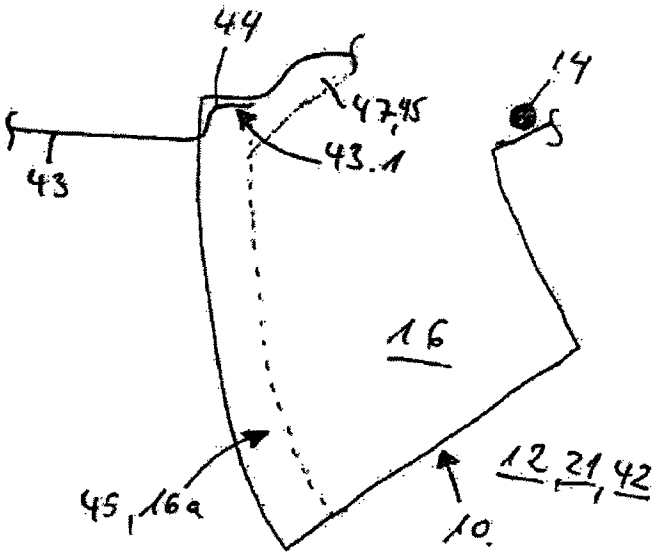
Figure 6A:
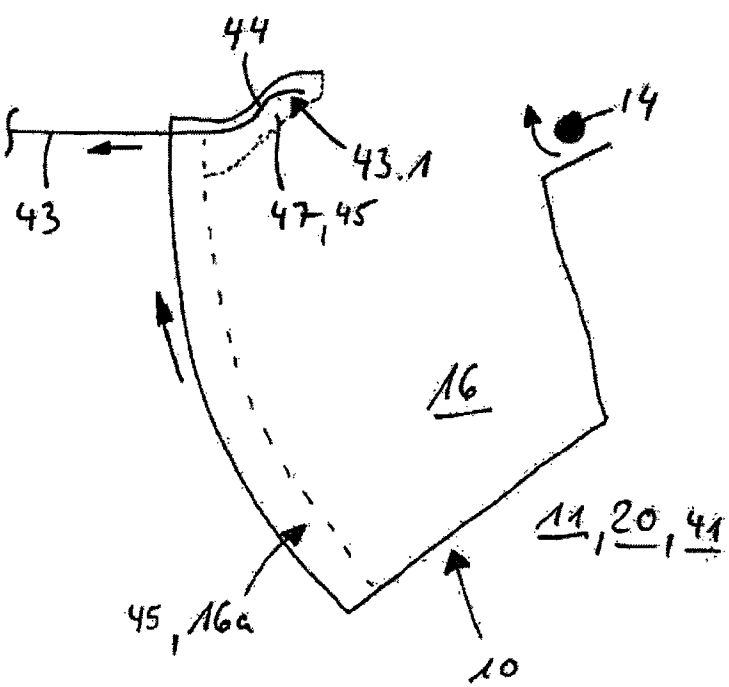
Figure 7:
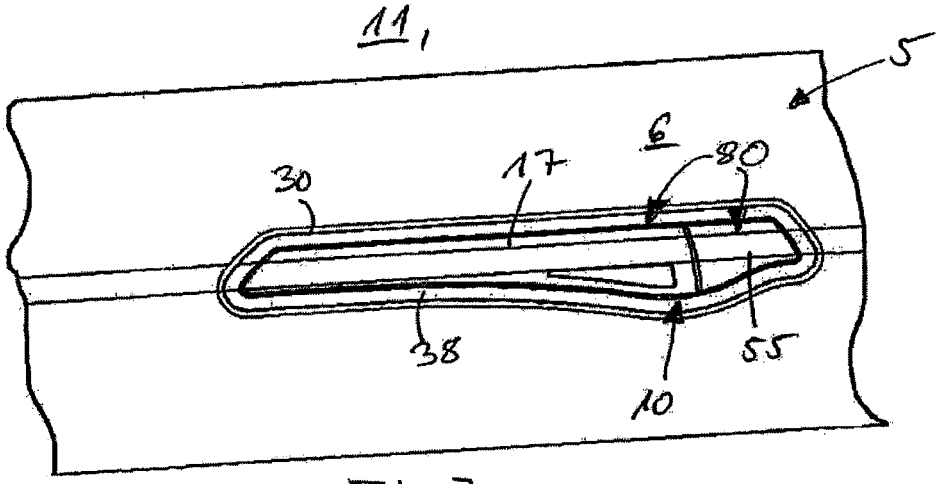
Figure 8:
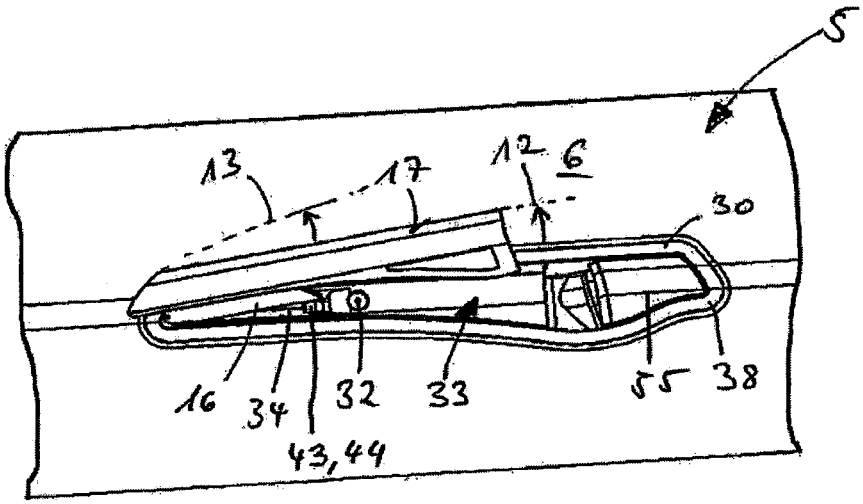
Figure 9:
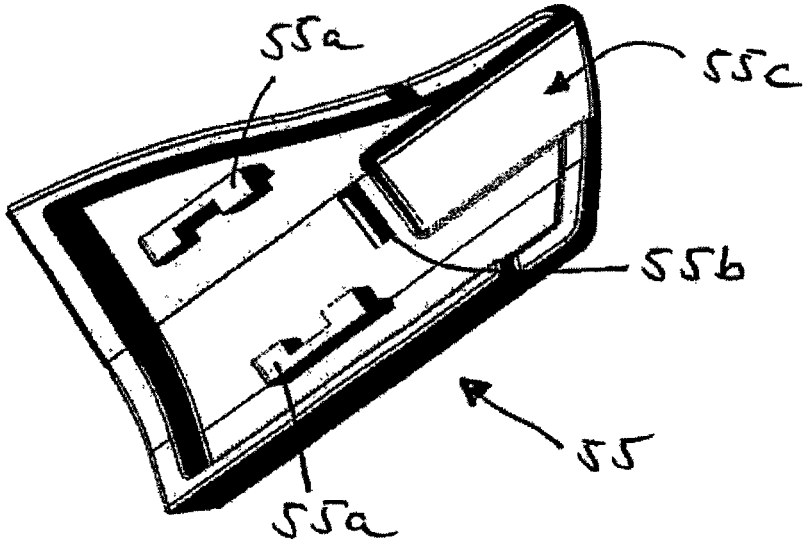
Figure 10:
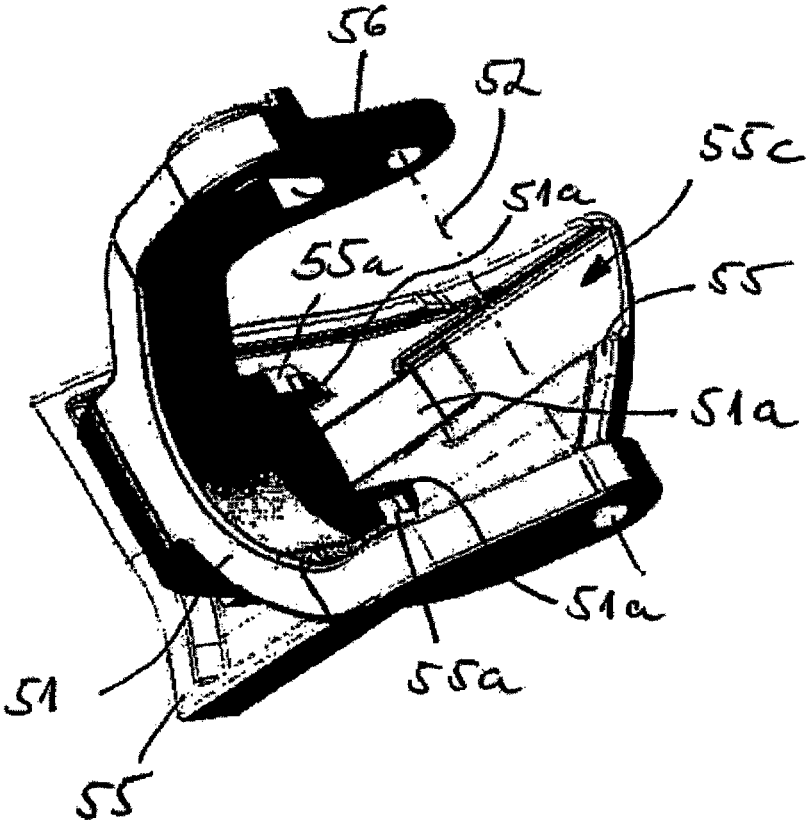
Figure 11:
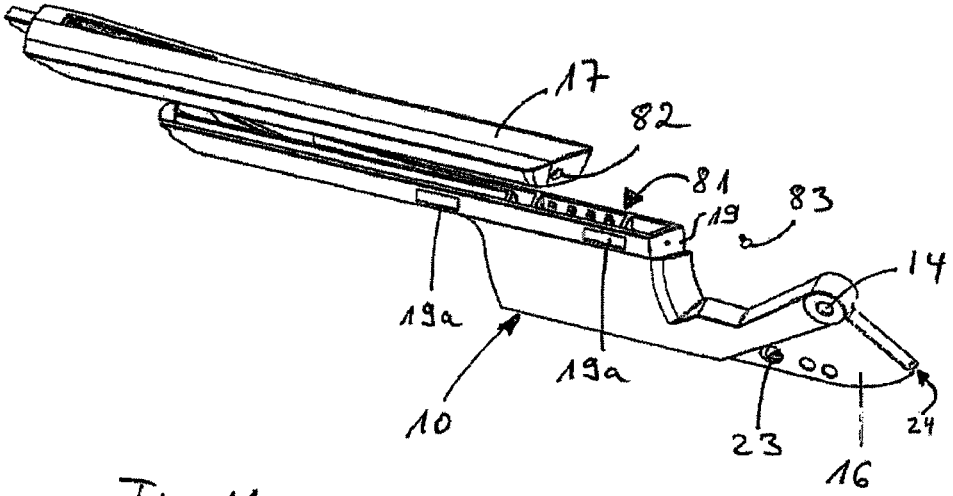

Further measures and advantages and technical features of the invention emerge from the claims, the description below and the drawings. The handle device according to the invention is illustrated in detail by a plurality of exemplary embodiments in the figures below, in which:

FIG. 1 shows an exploded illustration of a handle device according to the invention for a locking device of a vehicle, FIG. 2 shows the handle device according to FIG. 1, wherein a blocking unit which is in the locking position is provided, FIG. 3 shows the handle device according to FIG. 1, wherein the blocking unit is in a release position, FIG. 4 shows an enlarged illustration of a handle mount from FIG. 1, FIG. 5 shows a further illustration of a handle mount from FIG. 1, FIG. 6*a* shows a purely schematic illustration of a partial region of the handle part and of the blocking unit, which is in the locking position thereof, FIG. 6*b* shows the blocking unit according to FIG. 6*a*, wherein the blocking unit is in the release position, FIG. 7 shows a possible embodiment of the handle device with a handle part which is in the rest position, FIG. 8 shows the handle part according to FIG. 7, the handle part being in an operating position, FIG. 9 shows a rear view of the second cover of the cover arrangement, FIG. 10 shows the second cover according to FIG. 9, to which second cover an actuating element 51 from FIG. 1 is fastened, and FIG. 11 shows an illustration of the handle part and of a first cover.

FIG. 1 shows one possible variant embodiment of a handle device for a locking device 7 of a vehicle. The locking device 7 is illustrated purely schematically in FIG. 1. The locking device 7 is part of a security system functioning without a key, in particular of an access and/or driving authorization control system of a motor vehicle. The security system can be in data communication, for example, with an ID transmitter 3, wherein, with a conscious action of the user, in particular at the ID transmitter 3 or at the handle device, an identification check can be carried out between the ID transmitter 3 and the security system. Given a positive identification, the locking device 7 can be brought from a locking state 20 into a release state 21 (also see FIGS. 2, 3, 6*a* and 6*b*). In the release state 21, opening of the door of the motor vehicle is possible, for example, and this will be discussed in more detail below.

The handle device has a handle part 10 which is mounted movably with respect to a door 5 of the vehicle. In this case, the handle part 10 is mounted rotatably about the axis 14 thereof. The bearing pin 15 forms the axis of rotation here.

The handle part 10 can be moved between a rest position 11, which is illustrated by way of example in FIG. 7, and an operating position 12, 13, which is shown in FIG. 8. In the rest position 11, the handle part 10 is flush with the outer side 6 of the door 5. In the operating position 12, 13, the handle part 10 protrudes from the outer side 6 of the door 5 in the manner of a projection.

As can be seen from FIG. 1, a handle mount 70 is provided, the handle mount being fastened on the inside of the door 5 and likewise being illustrated in FIG. 4 and FIG. 5. In addition, the handle device has a handle shell 30 which is arranged on the opening 8 of the door 5, wherein the handle shell 30 is fastened to the handle mount 70. In the present exemplary embodiment, the handle shell 30 is fastened to the handle mount 70 via a screw connection 32.

In the rest position 11 of the handle part 10, the handle part 10 is located in a receptacle 33 of the handle shell 30. The receptacle 33 therefore completely accommodates the handle part 10 in the rest position 11 thereof. The handle part 10 has an extension 16 which extends in the direction of the handle mount 70 and through which the axis of rotation 14 runs. The extension 16 extends through a first opening 34 in the handle shell 30. The handle shell 30 furthermore has two spaced-apart webs 35 which are connected to each other by the bearing pin 15 which forms the axis of rotation 14 for the handle part 10.

In addition, the handle shell 30 has a second opening 36, and a locking cylinder 9 is accommodated within said opening 36. The locking cylinder 9 is fixed on the handle mount 70 via a fastening element 22.

A third opening 37 is furthermore provided on the handle shell 30, which opening is provided for an actuating unit 50. The actuating unit 50 has an actuating element 51 which is arranged rotatably on a bearing point 72 of the handle mount 70. In this case, the actuating element 51 has an axis of rotation 52. The axis of rotation 52 is formed by the pins 53. In addition, the actuating element 51 is loaded by a spring element 54. Said spring element is likewise shown in FIGS. 2 and 3.

The actuating unit 50 furthermore has a cover 55 which is matched to the contour of the receiving opening 33 in the handle shell 30. In addition, the handle part 10 has a cover 17 which is directed toward the outer side 6 of the vehicle door 5 and is arranged adjacent to the cover 55. Said cover 17 also completely covers the handle part 10 and the receiving opening 33 in the handle shell 30 when the handle part 10 is in the rest position 11 thereof.

The actuating unit 50 is operatively connected to a blocking unit 40. The blocking unit 40, which prevents unintentional opening of the door 5 as a consequence of the action of accelerations acting on the handle part 10, can be displaced between a locking position 1, which is illustrated in FIG. 6*a*, and a release position 2, which is illustrated in FIG. 6*b*.

Movement of the handle part 10 is permitted in the release position 2. By contrast, movement of the handle part 10 is blocked in the locking position 1, and therefore, for example in the event of a side impact, an unintentional opening of the door 5 is effectively prevented.

According to the exemplary embodiment illustrated, the blocking unit 40 always adopts the locking position 1 thereof. The blocking unit 40 can be brought from the locking position 1 into the release position 2, which is shown in FIGS. 2 and 3, only by a conscious activation of the actuating unit 50 by the user.

According to FIG. 2 and FIG. 3, the actuating unit 50 is coupled to the blocking unit 40. In this connection, the blocking unit 40 has a blocking element 43 which is illustrated in FIGS. 1 to 5. The blocking element 43 extends longitudinally in the direction of the vehicle R and is of rod-like design. The blocking element 43 here has a defined curved profile. The blocking element 43 can be formed from a metal or else from a plastic, in particular a fiber-reinforced plastic.

The blocking element 43 has a first end 43.1 and a second end 43.2, wherein the first end 43.1 interacts with the handle part 10 which is shown in FIG. 5, FIG. 6*a* and FIG. 6*b*. The second end 43.2 of the blocking element 43 is arranged on the actuating unit 50 and is illustrated in FIGS. 2 to 4. The actuating element 51 which is pivotable about the axis 52 has an elongated hole 56 in which the second end 43.2 of the blocking element 43 engages. According to FIG. 2, the handle part 10 is in the rest position 11 thereof, and the actuating unit 50 with the cover 55 thereof is in the starting position thereof, wherein both covers 17, 55 are arranged flush with the outer side 6 of the door 5. If conscious activation of the actuating unit 50 now takes place by the cover 55 being pressed in manually, the actuating element 51 pivots about the axis 52, wherein the actuating element 51 rotates counterclockwise about the axis 52. At the same time, the blocking element 43, which is guided in the elongated hole 56, is displaced in a translatory manner to the right. The spring element 54 acts in the clockwise direction on the actuating element 51 with a defined spring force. By means of said translatory displacement of the blocking element 43 from the first position 41 thereof according to FIG. 2, in which said blocking element acts with the first end 43.1 thereof in a locking manner in the handle part 10, which is shown in FIG. 6*a*, the blocking element 43 moves owing to the described actuation of the actuating element 51 according to FIG. 3 into a second position 42 which said blocking element reaches in FIG. 3 and in FIG. 6*b* and in which said blocking element is detached from the handle part 10.

If the blocking element 43 is in the second position 42 thereof, the handle part 10 can be moved out of the secured rest position 11 thereof into an extended operating position 12, 13. The handle part 10 can be moved into the respective position 11, 12, 13 thereof via a drive 60 which is illustrated schematically in FIG. 1. In the present exemplary embodiment, the blocking unit 40, which acts as a crash interlock, is at the same time the drive 60 for a corresponding movement of the handle part 10 into the respective position 12 thereof. According to FIG. 4 and FIGS. 6*a* and 6*b*, the blocking element 43 is designed with a geometrically shaped section 44 which makes contact by means of the section 44 with the handle part 10 during the transfer from the first position 41 into the second position 42 and therefore, according to FIG. 6*a*, presses the handle part 10 in the clockwise direction about the axis 14 in the direction of the operating position 12, 13. The section 44 is likewise shown in FIG. 8, said section pressing the handle part 10 out of the door 5.

According to the exemplary embodiment illustrated in FIG. 5, the extension 16 of the handle part 10 has a groove 16*a*, wherein the first end 43.1 of the blocking element 43 projects into a latching opening 47, which is shown in FIG. 6*a*. If the described translatory movement of the blocking element 43 in the direction of the operating position 12, 13 takes place, the shaped section 44 presses against an edge region of the handle part 10 which is moved by the movement of the blocking element 43 in the clockwise direction about the axis 14 and reaches the first operating position 12 according to FIG. 6*b*.

A spring element 46, which is illustrated in FIG. 1 and FIG. 5, acts on the extension 16 in order to move the handle part 10 back again into the rest position 11 thereof. However, according to FIG. 6*b*, owing to the position of the blocking element 43, the handle part 10 is held in the first operating position 12.

According to FIG. 8, the handle part 10 can be brought from the first operating position 12 thereof into a second operating position 13, wherein the handle part 10, in the second operating position 13 thereof, protrudes further from the outer side 6 of the door 5 than in the first operating position 12 thereof. By means of manual movement of the handle part 10 from the first operating position 12 into the second operating position 13, the locking device 7 according to FIG. 1 can be correspondingly activated, as a result of which the lock of the locking device 7 is opened and therefore the user can open the door 5 of the vehicle. Upon movement of the handle part 10 about the axis 14 thereof from the first operating position 12 into the second operating position 13, the blocking element 43 remains with the first end 43.1 thereof in the groove 16*a* of the extension 16 (see FIG. 6*a* and FIG. 6*b*). It is therefore ensured that, when the handle part 10 is returned from one of the operating positions 12, 13 into the rest position 11, the blocking unit 40 reliably reaches the locking position 1 thereof, which means that the blocking element 43 reliably moves with the first end 43.1 thereof into the latching opening 47 during the return movement of the handle part 10 into the rest position 11 thereof.

The locking cylinder 9, which can be actuated, according to FIG. 3, by a key, is exposed at the same time as the movement of the actuating element 51. Blocking and unlocking of the locking device 7 and opening of the lock of the locking device 7 can likewise be obtained by actuation of the locking cylinder 9. A cavity 18 is formed within the handle part 10, and an electronic unit can be located within said cavity 18. According to FIG. 1, the cover 17 has an additional covering 17*a* which is designed to be transparent to light. A lighting element is located behind the covering 17*a*. The covering 17 serves as a light-transparent window.

According to FIG. 6*a* and FIG. 6*b*, the groove 16*a* of the extension 16 and the latching opening 47 form a security contour 45, as a result of which reliable moving back and transfer of the blocking element 43 into the first position 41 thereof and the transfer of the blocking unit 40 into the locking position 1 are ensured.

According to FIG. 5, the extension 16 of the handle part 10 is designed with a fastening opening 23. A force transmission element, here a Bowden cable, for example, can be fastened in the fastening opening 23. The Bowden cable is connected to the locking device 7 from FIG. 1, wherein an opening operation of the lock of the locking device 7 can be brought about by a corresponding movement of the handle part 10 from the first operating position 12 into the second operating position 13. The Bowden cable is guided within the guide 24 of the handle part 10, which guide 24 is also shown in FIG. 11.

According to FIG. 1, the handle mount 70 is designed with a bearing point 71 along which the blocking element 43 is guided. Said bearing point 71 is shown in an enlarged illustration according to FIG. 4. Reliable linear guidance of the blocking element 43 within the handle device is obtained as a result.

According to FIG. 1, the handle shell 30 has a bearing 31, as a result of which the handle part 10 is mounted pivotably about the axis 14.

Of course, it is possible, as an alternative and/or in addition, for the blocking element 43 to execute a rotational or pivoting movement instead of a linear movement in order to move from the first position 41 into the second position 42 and vice versa.

According to FIG. 1, the first cover 17 and the second cover 55 are part of a cover arrangement 80 which is fastened with respect to the outer side 6 of the door 5 to the handle part 10. In this case, the cover arrangement 80 is arranged substantially flush with the outer side 6 of the door 5. The handle part 10 and the handle shell 30 constitute a first installation module 90, wherein the first installation module 90 is inserted on the overall opening 8 of the door 5 and is fastened to the handle mount 70 via a screw connection 32. In the present exemplary embodiment, the cover arrangement 80 is enameled.

As illustrated in FIG. 7 and FIG. 8, the first cover 17 is adjacent to the second cover 55. As FIG. 2 and FIG. 3 show, the cover arrangement 80 closes the receptacle 33 of the handle shell 30 at least in the rest position 11 of the handle part 10. In this case, the cover arrangement 80 is arranged flush with the edge region 38 of the handle shell 30 and with the outer side 6 of the door 5.

FIG. 9 shows the second cover 55 from the rear side thereof. Like the first cover 17, the second cover 55 is part of the cover arrangement 80. The second cover 55 has two latching elements 55*a* which extend in the direction of the actuating element 51 in the manner of projections. Furthermore, a latching element 55*b* which is designed as a depression is provided. At a distance from the depression 55*b*, the second cover 55 has an extending guide 55*c*. FIG. 10 shows the fastening of the second cover 55 to the actuating element 51. In this case, the actuating element 51 has counter-latching elements 51*a* which interact with the latching elements 55*a*, 55*b*. In the fitted state, the guide 55*c* provides the possibility of pushing an object or a key under the second cover 55, in particular of introducing said object or key into the guide 55*c*. By means of a corresponding movement of said introduced object, the counter-latching element 51*a* can be correspondingly moved out of the latching position thereof, thus enabling the second cover 55 easily to be removed from the actuating element 51.

FIG. 11 shows the handle part 10 which is formed with a collar region 19. The first cover 17 can be placed onto the collar region 19. In this connection, the collar region 19 has latching elements 19*a*. The latching elements 19*a* are designed here as receiving openings. The first cover 17 has counter-latching elements (not illustrated explicitly) which, in the fitted state, interact with the latching elements 19*a*, thus enabling a reliable fastening of both components 17, 10 to be obtained. The handle part 10 has an opening 81 within which, for example, an electronic unit can be arranged. In the fastened state of the first cover 17 to the collar region 19, reliable sealing and closing of the opening 81 can be obtained. In addition, said latching connection between the components 17, 19 and 10 is secured by a fastening element, here a screw 83, the screw 83 projecting into an opening 82 in the first cover 17.

LIST OF DESIGNATIONS

1 Locking position
2 Release position
3 ID transmitter
5 Door
6 Outer side of the door
7 Locking device
8 Opening of the door, overall opening
9 Locking cylinder
10 Handle part
11 Rest position
12 Operating position, first operating position
13 Operating position, second operating position
14 Axis
15 Bearing pin
16 Extension
16*a* Groove of the extension
17 Cover, first cover
17*a* Covering
18 Cavity
19 Collar region
19*a* Latching element
20 Locking state
21 Release state
22 Fastening element
23 Fastening opening
24 Guide
30 Handle shell
31 Bearing
32 Screw connection
33 Receptacle
34 First opening
35 Web
36 Second opening
37 Third opening
38 Edge region

40 Blocking unit
41 First position
42 Second position
43 Blocking element
43.1 First end of the blocking element
43.2 Second end of the blocking element
44 Section of the blocking element
45 Security contour
46 Spring element
47 Latching opening
50 Actuating unit
51 Actuating element
51*a* Counter-latching element
52 Axis
53 Pin
54 Spring element
55 Cover, second cover
55*a* Latching element
55*b* Latching element
55*c* Guide
56 Elongated hole
60 Drive
70 Handle mount
71 Bearing point
72 Bearing point
80 Cover arrangement
81 Opening in 10
82 Opening
83 Screw, fastening element
90 Installation module
R Direction of the vehicle

The invention claimed is:

1. A handle device for a locking device of a vehicle having a door with an opening, said handle device comprising:

a handle part operatively connected to a locking device and movably mountable with respect to the door of the vehicle, and said handle part at least partially extendible through the opening of the door and being displaceable between a rest position and an operating position, wherein in said operating position, the locking device is opened allowing opening of the door;

a handle shell arranged on the opening and on which the handle part is movably mounted;

a handle mount arranged fixedly within the door and to which the handle shell is fastened;

an actuating unit operatively connected to the handle part in such a manner that, when the actuating unit is activated, the handle part can be displaced between the rest position and the operating position, the actuating unit having an actuating element mounted movably on the handle mount; and a cover arrangement fastened to the handle part with respect to an outer side of the door, the cover arrangement having a first cover and a second cover, wherein the first cover is fastened to the handle part and the second cover is fastened to the actuating element, and wherein the first cover is arranged adjacent to the second cover, wherein when the actuating unit is actuated, the second cover pivots in the direction of the handle part, wherein the second cover pivots under the handle part as soon as the handle part moves together with the first cover from the rest position in the direction of the operating position.

2. The handle device as claimed in claim 1, in which the cover arrangement is arranged substantially flush with respect to the outer side of the door.

3. The handle device as claimed in claim 1, in which an electronic unit is arranged on the handle part, said electronic unit being part of a security system.

4. The handle device as claimed in claim 1, in which the cover arrangement is fastened to the handle part using at least one method selected from a group consisting of interlocking said cover arrangement and handle part, frictionally engaging said cover arrangement and handle part, integrally bonding said cover arrangement to said handle part, clipping said cover arrangement onto the handle part, and screwing the cover arrangement onto the handle part.

5. The handle device as claimed in claim 1, in which a first installation module is formed by the handle part and the handle shell, wherein the first installation module is insertable on the opening of the door and is fastenable to the handle mount.

6. The handle device as claimed in claim 1, in which the handle shell conceals the opening and has a first opening for the handle part and a second opening for a locking cylinder.

7. The handle device as claimed in claim 1, in which the cover arrangement is at least one of enameled and chromium-plated.

8. The handle device as claimed in claim 1, in which the handle shell has an opening through which the actuating element at least partially protrudes.

9. The handle device as claimed in claim 1, in which the handle shell has an elongate extent in which the handle part having a likewise elongate extent bears at least flush, wherein the actuating unit is preferably arranged adjacent to the handle part as an extension of the elongate extent of the handle part.

10. The handle device as claimed in claim 1, in which the second cover selectively conceals a locking cylinder and, when the actuating unit is activated, the second cover is movable to reveal the locking cylinder for access.

11. The handle device as claimed in claim 1 in which a blocking unit is arranged on the handle mount for preventing an unintentional opening of the door as a consequence of the effect of accelerations acting on the handle part.

12. The handle device as claimed in claim 1, in which the handle part has a collar region onto which the first cover is placed, wherein the collar region has latching elements interacting with counter-latching elements of the first cover.

13. The handle device as claimed in claim 1, in which the second cover has at least one latching element which interacts with a counter-latching element of the actuating element, and the second cover has a guide running on an inner side with respect to the actuating element.

14. The handle device as claimed in claim 1, in which the handle shell has a receptacle in which the handle part is accommodated in the rest position.

15. The handle device as claimed in claim 14, in which the cover arrangement closes the receptacle of the handle shell at least in the rest position of the handle part, wherein the cover arrangement is arranged flush with at least one of an edge region of the handle shell and an outer side of the door.

* * * * *